US006679386B2

(12) United States Patent
Tsutsumi

(10) Patent No.: US 6,679,386 B2
(45) Date of Patent: Jan. 20, 2004

(54) LOW-DENSITY PARTICLE SIZING APPARATUS AND METHOD

(75) Inventor: Masataka Tsutsumi, Canton, OH (US)

(73) Assignee: Sizetec, Inc., Canton, OH (US)

( * ) Notice: Subject to any disclaimer, the term of this patent is extended or adjusted under 35 U.S.C. 154(b) by 0 days.

(21) Appl. No.: 10/159,244

(22) Filed: May 29, 2002

(65) Prior Publication Data

US 2002/0179500 A1 Dec. 5, 2002

Related U.S. Application Data

(60) Provisional application No. 60/294,660, filed on May 31, 2001.

(51) Int. Cl.[7] ..... B07C 1/49

(52) U.S. Cl. ..... 209/415; 209/366; 209/365.1; 209/365.3; 209/365.4; 209/331; 209/415

(58) Field of Search ..... 209/365.4, 368.3, 209/365.1, 366, 409, 415, 366.5, 331, 332, 344

(56) References Cited

U.S. PATENT DOCUMENTS

| | | | | | |
|---|---|---|---|---|---|
| 529,872 | A | | 11/1894 | Morse | |
| 2,204,379 | A | * | 6/1940 | Overstrom | 209/326 |
| 4,402,826 | A | * | 9/1983 | Uchitel et al. | 209/366.5 |
| 5,037,535 | A | * | 8/1991 | Bruderlein | 209/310 |
| 5,301,814 | A | * | 4/1994 | Lower et al. | 209/326 |
| 5,301,815 | A | | 4/1994 | Chauvin et al. | |
| 5,595,306 | A | | 1/1997 | Hukki et al. | |
| 5,730,297 | A | * | 3/1998 | Lower et al. | 209/332 |
| 5,927,513 | A | * | 7/1999 | Hart | 209/677 |

OTHER PUBLICATIONS

Rotex Inc. flyer entitled "Rotex® Screeners" email address http://www.rotex.com/rotex/screeners/rotex.shtml; copyright 1999 Rotex Inc.

Rotex Inc. flyer entitled "3 ways ROTEX accuracy increases your profits"—Rotex Inc. 1230 Knowlton Street, Cincinnati, OH 45223.

Rotex Inc. flyer entitled "How to control screen blinding" No. 7 of a series, Catalog 806, Rotex Inc, 1230, Knowlton Street, Cincinnati, OH 45223.

Great Western flyer entitled "Stainless Steel Tru–Balance Sifter" (2 pages) Great Western Manufacturing Company, Inc., 208 Choctaw, P.O. Box 149, Leavenworth, KS 66048–0149.

* cited by examiner

*Primary Examiner*—Donald P. Walsh
*Assistant Examiner*—Jonathan R Miller
(74) *Attorney, Agent, or Firm*—Buckingham, Doolittle & Burroughs, LLP; David P. Dureska; Edward T. Kennedy

(57) ABSTRACT

An apparatus and method for sizing and separating particles of generally low-density materials includes a stand, a frame movably suspended on the stand by a plurality of suspension assemblies, and an elongated screen box mounted on the frame. The screen box receives material to be processed at an input end and includes openings at an output end for discharging processed material. The frame and screen box are disposed at an incline relative to a horizontal surface on which the stand rests, so that material travels downwardly in the screen box toward the output openings. A vibrator motor is mounted on the frame input end. The arrangement of the motor and suspensions results in imposition of a combination generally circular planar motion to the frame and screen box at the input end and a generally oblong linear reciprocating motion at the central portion and the output end of the apparatus.

20 Claims, 6 Drawing Sheets

LOW-DENSITY PARTICLE SIZING APPARATUS AND METHOD

This application claims the benefit of provisional application 60/294,660 filed on May 31, 2001.

BACKGROUND OF THE INVENTION

The invention relates to screens for material processing and in particular to a screen apparatus and method for sizing and separating particles of materials by motorized vibration of one or more screens. More particularly, the invention is directed to a material processing apparatus and method which enables efficient sizing and separation of particles of low-density materials.

BACKGROUND ART

Material sizing equipment commonly is used in a variety of industrial processes including mineral processing of coal, iron ore, kaolin, bauxite, taconite, gold, phosphate, potash, silica sand, aggregate, and limestone. Such sizing equipment also is useful in chemical processing, pulp and paper processing, food processing, waste water and sewage treatment, refuse processing, soil processing, oil well drilling fluid cleaning, and in processing low-density materials such as fertilizer and plastic pellets. Equipment of the type intended for sizing and separating particles of a material usually includes a stand, a frame movably suspended on the stand, one or more elongated screens of varying sizes, depending on the processing application, mounted on the frame, and one or more motors mounted on the frame for vibrating the frame and attached screen. The material typically is deposited on one end of the vibrating screen, which sizes and separates particles of the material as it moves along the screen. The screen can be disposed horizontally and parallel to the surface on which the sizing equipment rests, or it can be inclined relative thereto with the material to be sized being deposited on the upper or lower end of the screen. In certain applications, the screen also serves to separate water from the material being sized.

Although such sizing equipment typically performs its intended functions well, it has become apparent in applications involving the sizing of low density dry materials having particles ranging in size from about 2 mesh (12 millimeters) to about 325 mesh (45 microns), that existing sizing equipment does not achieve efficient separation of these types of materials. More specifically, most sizing equipment does not apply a combination generally circular planar motion to one end of the screen, and a generally oblong linear reciprocating planar motion to the opposite end of the screen and the central portion of the screen. Rather, other types of forces, such as those generated by non-planar gyratory motions applied to the screens, are utilized in many prior art sizing apparatus. While this type of gyratory motion, as well as other types of motions such as those that generate generally vertical forces, work satisfactorily for sizing particles of relatively higher density materials, such prior art known vibrating motions are not the most efficient motions for achieving separation of particles of lower density materials.

However, certain known prior art particle sizing equipment has been developed in an attempt to efficiently achieve sizing and separation of particles of low-density materials. Rotex Inc. utilizes equipment which applies a generally circular planar motion to only one end of its screen, while also generally reciprocating the central portion and the opposite end of the screen in an oblong linear motion and in the same direction as the line of travel of material along the screen. However, this motion is achieved by a relatively complex crankshaft gear and leaf spring arrangement of parts, rather than one or more vibratory motors, together with bouncing balls disposed beneath the sloped screen to control screen blinding or clogging, to achieve sizing and separation of particles of low density materials. Similarly, Great Western Manufacturing Company, Inc. also utilizes a non-vibratory drive system rather than a vibratory motor to apply a generally large circular motion to the entire screen to enable sizing and separation. However, such sizing equipment is relatively complicated and expensive to manufacture and maintain, and still does not achieve desired levels of sizing and separation of particles of low-density materials.

The present invention solves a long-felt need in the material sizing art of how to efficiently size and separate particles of relatively low-density materials, by utilizing a certain vibratory motor placement and elongated sizing frame and screen, together with an arrangement of a plurality of various suspension assemblies, to aid material movement on the screen in such a manner as to achieve efficient sizing and separation of particles of low-density materials in equipment which is cost efficient to manufacture and maintain.

SUMMARY OF INVENTION

Objectives of the present invention include providing a sizing apparatus and method which efficiently sizes and separates particles of low-density materials, while utilizing a traditional vibratory motor.

Another objective of the present invention is to provide such a sizing apparatus and method which is relatively simple, inexpensive, reliable and easy to use and maintain.

These objectives and advantages are obtained by the apparatus for sizing and separating particles of a material of the present invention, the apparatus including a stand, a frame, means attached to the stand and the frame for movably suspending the frame on the stand, an enclosure mounted on the frame, the enclosure having a material input end, a central portion and a material output end, at least one screen mounted in the enclosure, the screen being inclined downwardly in a direction from the enclosure input end to the enclosure output end, and a vibratory motor mounted on the frame, so that a generally circular planar motion is imparted to the frame, the enclosure and the screen at the enclosure input end, and a generally oblong linear reciprocating motion is imparted at the enclosure central portion and the output end.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
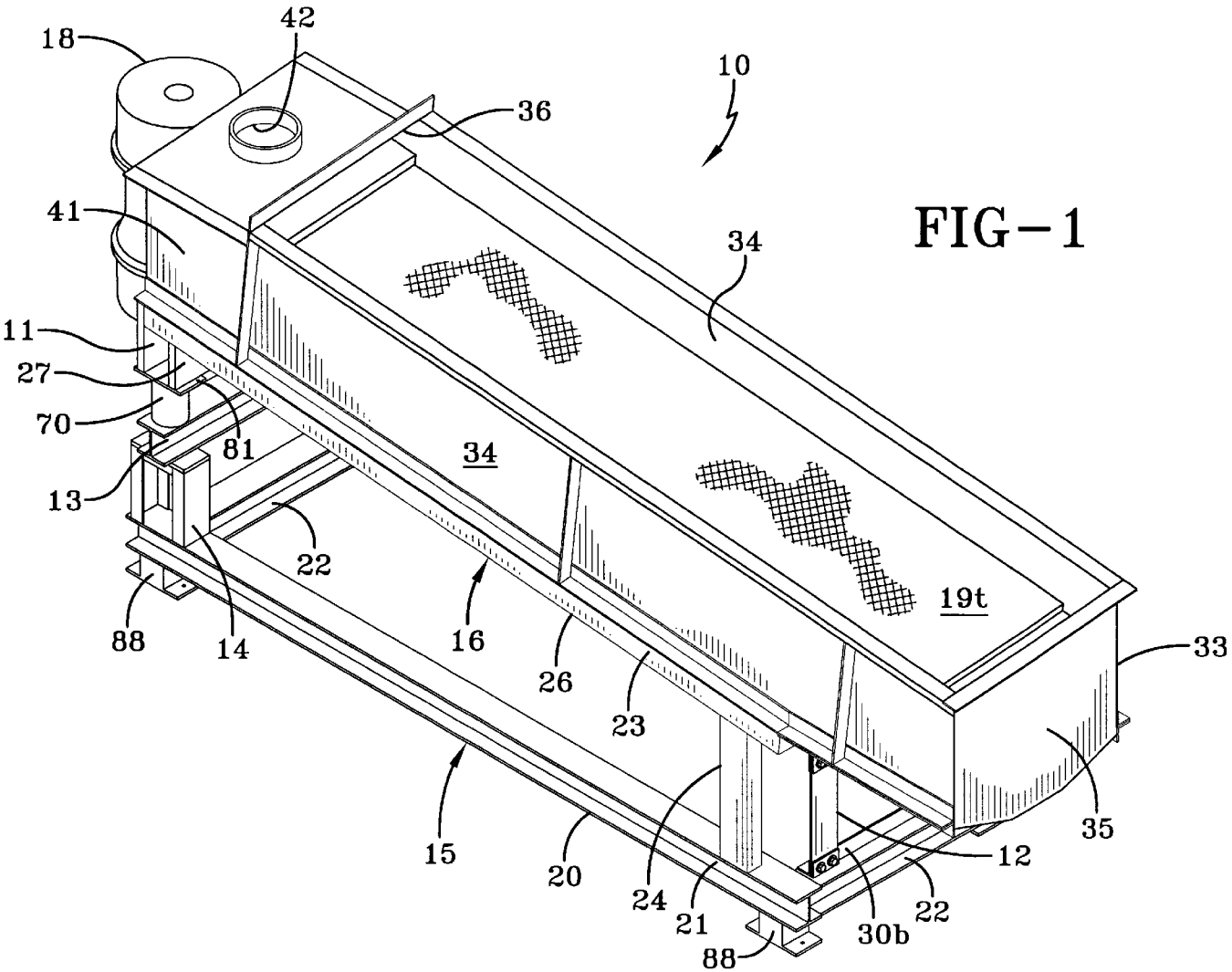
FIG. 1 is a perspective view of the sizing apparatus of the present invention for sizing and separating particles of relatively low-density materials.
Figure 3:
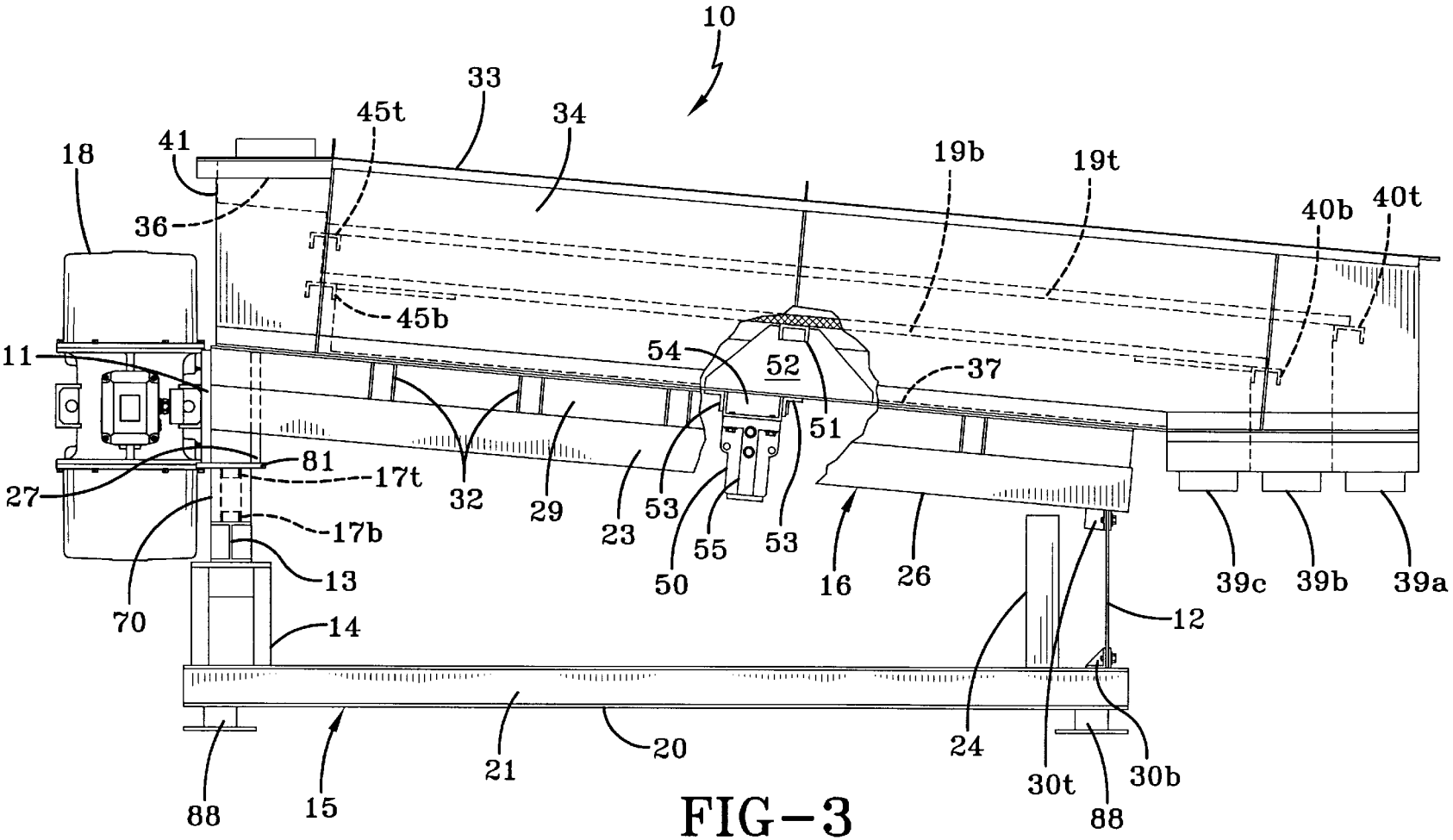
FIG. 3 is a side view of the sizing apparatus shown in FIG. 1, with hidden parts represented by broken lines.

The particle sizing and separating apparatus for low-density materials of the present invention is indicated generally at 10, and is shown in FIGS. 1 and 3. Sizing apparatus 10 comprises a stand 15, a frame 16, a pair of suspension leaf springs each indicated at 12 and extending between one end of the stand and the frame, a plurality of suspension elastomeric springs each indicated at 70 and extending between an opposite end of the stand and the frame, a vibrator motor 18, and a pair of screens 19*t* and 19*b*. Unless otherwise noted, all components of sizing apparatus 10 preferably are formed of a sturdy metal such as steel.

Stand 15 includes a generally rectangular-shaped base 20 comprising a pair of spaced, parallel, elongated side I-beams 21, and a pair of spaced, parallel, elongated end I-beams 22 which extend between and are connected, by any suitable means such as welds, to the ends of side I-beams 21 to form sturdy base 20 (FIGS. 1 and 3). An inverted generally U-shaped safety member 24 extends between and is connected, by any suitable means such as welds, to the top surface of each side I-beam 21 on the right-hand side or output end of base 20. An upright pillar 14 is disposed on each corner of the left-hand or input end of base 20, and connected by any suitable means such as welds. An elongated transverse I-beam 13 extends between and is connected, by any suitable means such as welds, to the top surface of each of upright pillars 14. Three bottom hubs 17*b* are spaced along the top surface of I-beam 13 and are each secured thereto, by any suitable means such as welds, to complete the structure of stand 15. A heavy-duty compression mount 88 is fastened, by any suitable means such as bolts, to the bottom surface of each corner of stand 15, and each of the mounts in turn is fastened, by any suitable means such as bolts, to the surface, such as a concrete floor, on which sizing apparatus 10 rests. Mounts 88 substantially prevent the transmission of noise and vibration, caused by vibrator motor 18, to the surface on which sizing apparatus 10 rests. A preferred compression mount 88 is sold by Tech Products Corporation, a Fabreeka Corporation, and is identified by Part No. 52137.

Figure 2:
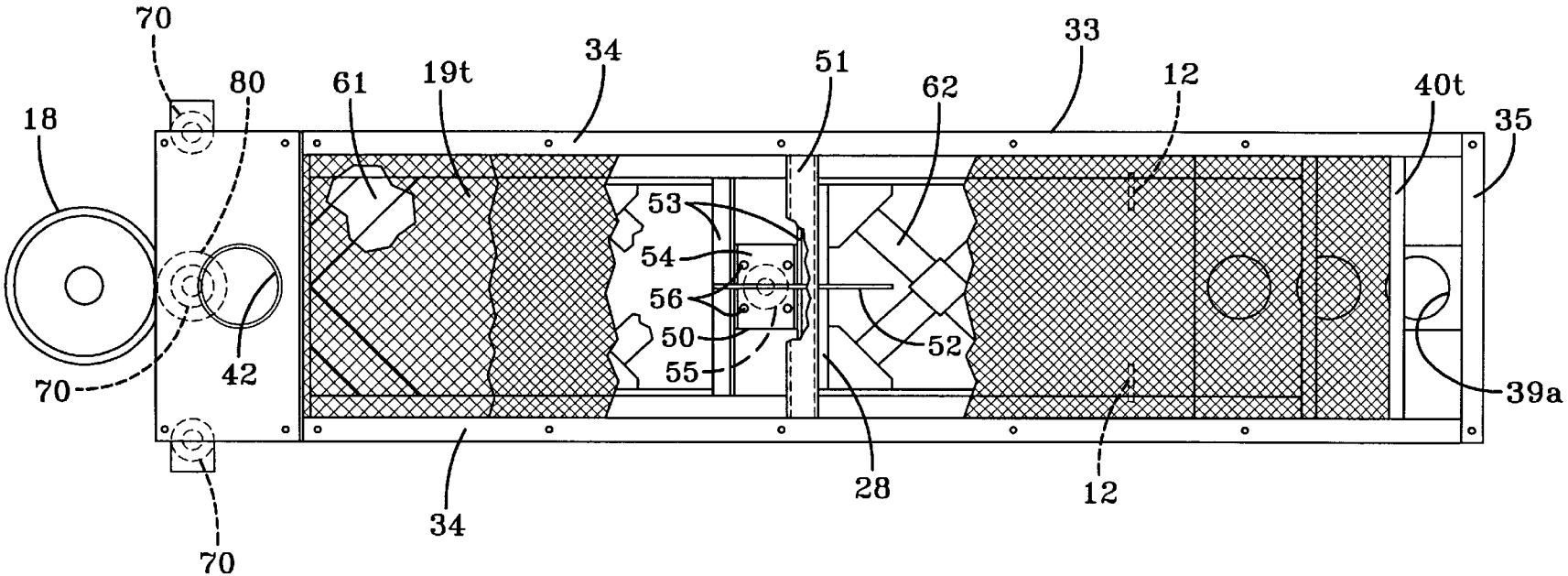
FIG. 2 is a top plan view of the sizing apparatus shown in FIG. 1, with a portion broken away and hidden parts represented by broken lines.
Figure 2A:
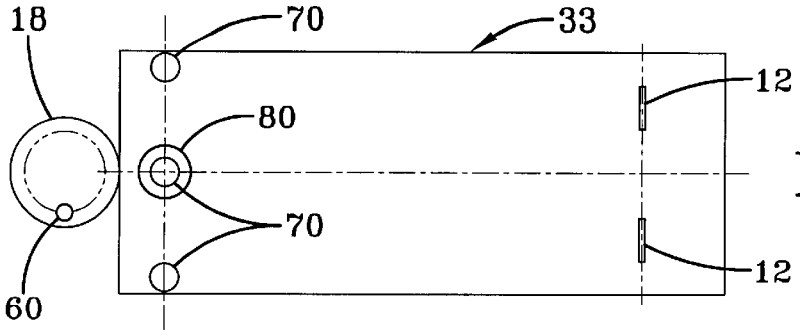
FIGS. 2A, 2B, 2C, and 2D are views similar to FIG. 2, but in diagrammatic form, illustrating with arrows the motion of the vibratory motor, and with solid lines representing the motion imparted on the sizing apparatus frame and screen enclosure by the motor as compared to the starting position of the frame and screen enclosure illustrated by broken lines.

Frame 16 includes a generally rectangular-shaped frame base 26 (FIGS. 1 and 3) comprising a pair of spaced, parallel, tubular elongated side members 23, and a pair of spaced, parallel, tubular elongated end members 25 which extend between and are connected, by any suitable means such as welds, to the ends of tubular side members 23. Frame base 26 further includes a tubular transverse central member 28 which extends between and is connected at its ends to the midpoints of tubular side members 23, by any suitable means such as welds (FIG. 2). A cross-shaped frame-strengthening assembly 62 extends between each end member 25 and transverse central member 28 to complete sturdy frame base 26.

Frame 16 also includes a pair of spaced, parallel vertical side plates 29, each of which is secured, such as by welds, to a respective one of side members 23 and extends substantially the entire length of the side member. Each one of a plurality of strengthening gussets 32 is welded to a respective one of vertical side plates 29 and its respective side member 23. The left-hand or input end of frame 16 further includes a vertically disposed motor mounting plate 11 that is attached to the exterior vertical wall of end member 25, by any suitable means such as welds, and a vertically disposed internal support plate 27 that is similarly attached to the interior vertical wall of the end member. More specifically, internal support plate 27 extends between and is coped at each of its ends (not shown) to engage and partially surround side members 23. Each end of support plate 27 is connected to its respective side member 23 by any suitable means such as welds. An end spring pad 81 extends between and is attached, by any suitable means such as welds, to the bottom surface of each end of mounting plate 11 and internal support plate 27. A central spring pad 82 is similarly attached to the central portion of mounting plate 11 and internal support plate 27, and is spaced from end spring pads 81. A top hub 17*t* is connected, by any suitable means such as welds, to the center of the bottom surface of each one of pads 81 and 82. A safety cylinder 80 is connected, by any suitable means such as welds, to the bottom surface of central pad 82, and is concentric to top hub 17*t*, to complete frame 16.

In accordance with one of the important features of the present invention, frame 16 is movably suspended on stand 15 at the left-hand or input end by cylindrical elastomeric springs 70 (FIGS. 1–4, and 6). More specifically, each spring 70 is of equal size and shape, and is longer than safety cylinder 80. A preferred spring 70 is formed of rubber and can be purchased from Firestone Industrial Products and is sold under the Marsh Mellow Trademark as part number W22-358-0180. Springs 70 each have an inside diameter sufficiently sized to frictionally fit about its respective top hub 17*t* of frame 16 and the corresponding bottom hub 17*b* of stand 15. It is understood that other types of left-hand or input end suspension systems could be employed in the present invention without affecting its overall concept, such as other types or numbers of springs, such as coil springs.

Figure 5:
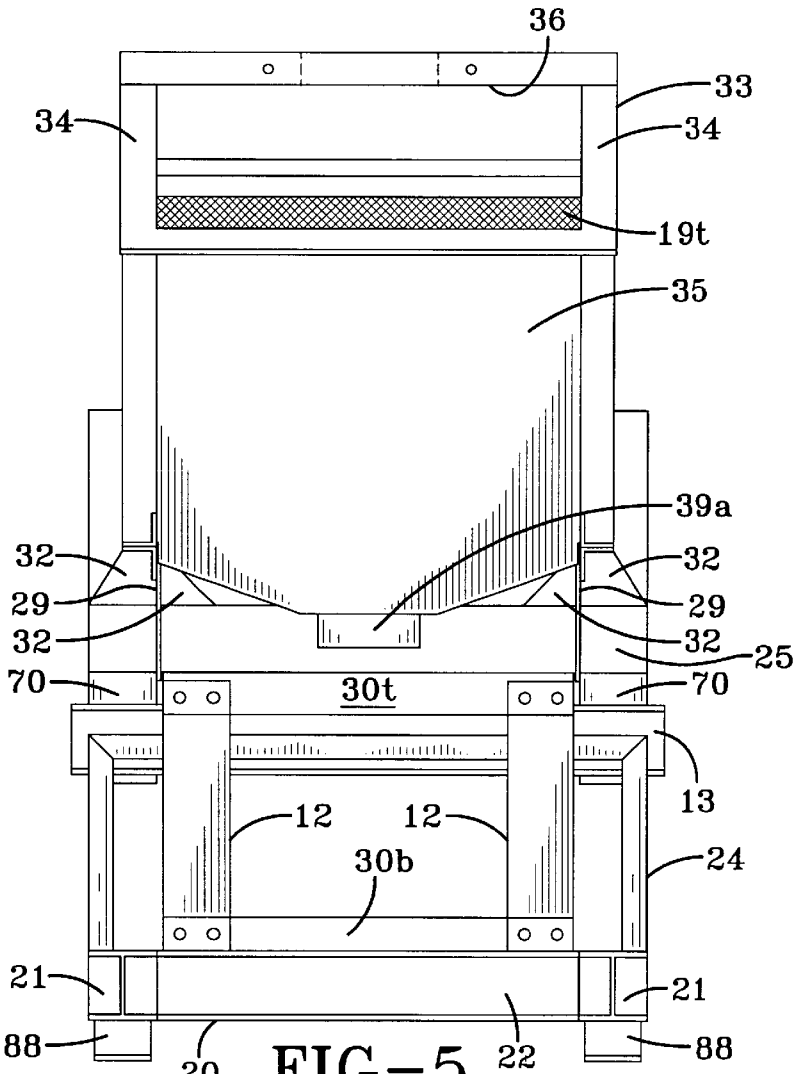
FIG. 5 is a right-hand end view of the sizing apparatus shown in FIG. 3, with hidden parts represented by broken lines.
Figure 4:
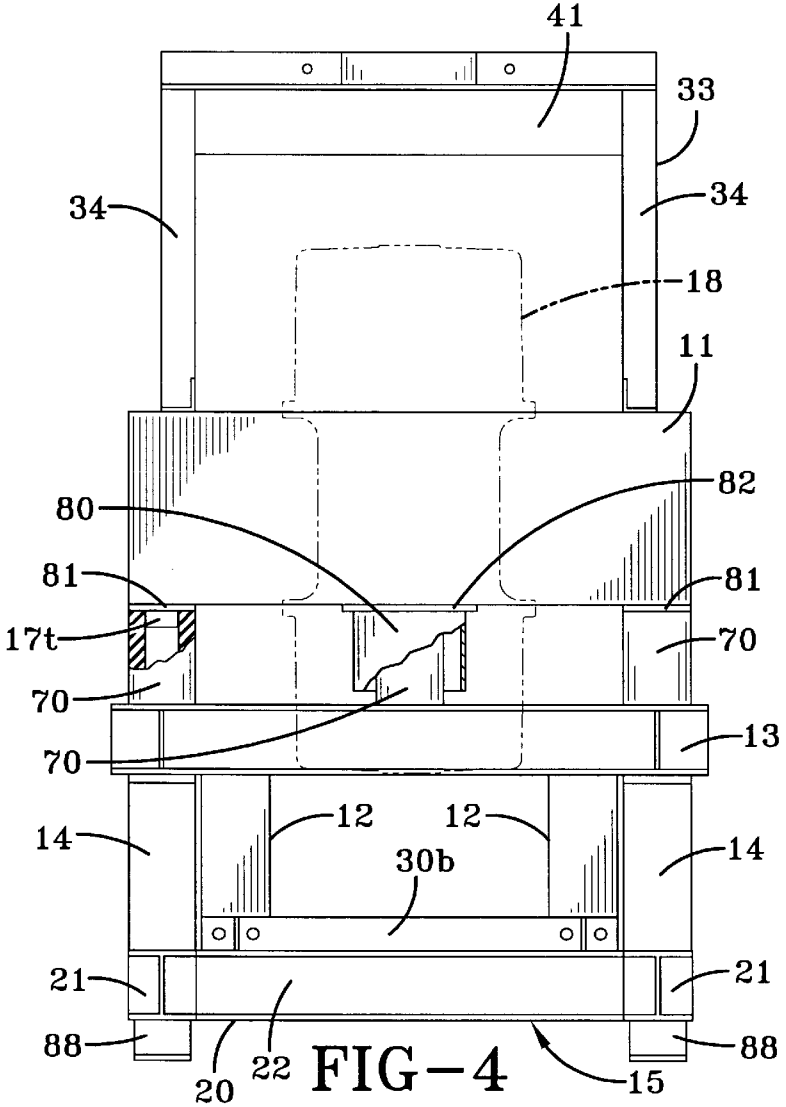
FIG. 4 is a left-hand end view of the sizing apparatus shown in FIG. 3, with portions broken away and in section and the motor represented by phantom lines.
Figure 6:
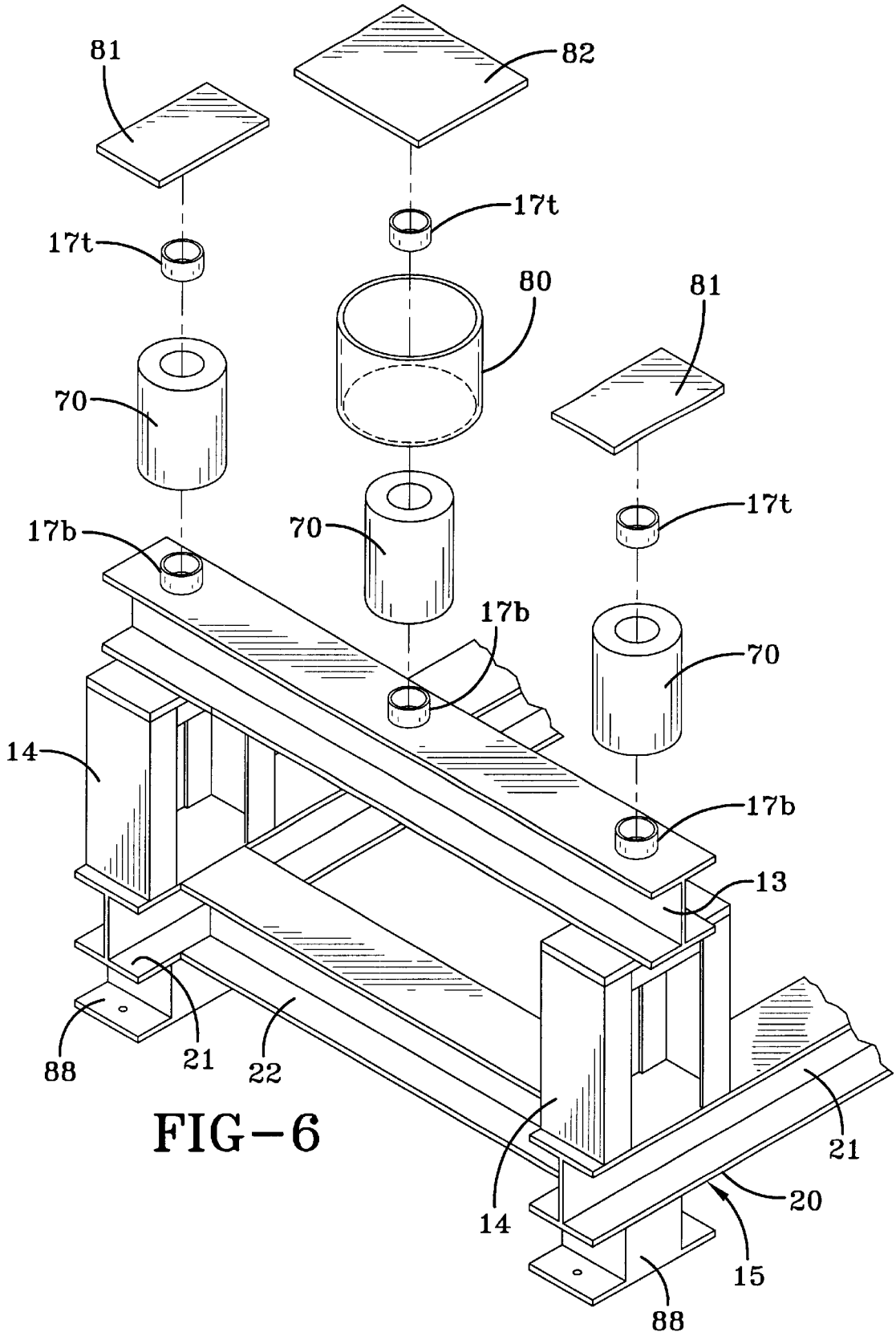
FIG. 6 is a fragmentary perspective view of a portion of the left-hand end of the sizing apparatus shown in FIG. 3, showing the disposition of the elastomeric suspension springs between the frame and the stand, with hidden parts represented by broken lines.

Frame 16 is movably suspended on stand 15 at the right-hand or output end by spaced-apart leaf springs 12. A preferred leaf spring 12 is sold by the 3M Company of Minneapolis, Minn., under the Scotchply brand name, is formed of fiberglass, and preferably is about three-eighths of an inch thick, about four inches wide, and about sixteen inches long. The bottom end of each leaf spring 12 is attached, by any suitable means such as nuts and bolts, to a transversely extending bracket 30*b*, which is in turn mounted on the upper surface of end I-beam 22 by any suitable means such as welds (FIGS. 3 and 5) The top end of each leaf spring 12 is similarly attached, by any suitable means such as nuts and bolts, to transversely extending bracket 30*t*, which in turn is mounted on the bottom surface of member 25 by any suitable means such as welds. It is understood that other types of right-hand or output end suspension systems also could be utilized in the present invention without affecting its overall concept, such as other types of springs, bushings, and the like.

In accordance with another important feature of the present invention, motor 18 is mounted by any suitable means, such as nuts and bolts, to the exterior face of mounting plate 11 on the input end of frame 16 (FIGS. 1–3). Motor 18 is of a type which is well-known in the sizing equipment industry, and includes a counterweight 60 (FIGS. 2A–3D) located within the motor. A preferred vibratory motor 18 is sold by Italvibras Spa of Modena, Italy, and bears model number CD6-6600. As best shown in FIG. 3, the shaft (not shown) of motor 18 is disposed perpendicular to sizing apparatus base 20, and due to the about ten degree slope of frame 16, motor shaft 18 is offset about ten degrees from the planar surface of screens 19. Vibratory motor 18, due to its orientation relative to screens 19*t, b* and frame 16, and the suspension springs 70 and 12 on the input and output ends, respectively, of sizing apparatus 10, transmits a generally circular planar motion to frame 16, a screen box 33, and screens 19 nearest the left-hand input end of the sizing apparatus, and a generally oblong linear reciprocating motion at the central and leaf spring end of the apparatus, with the reciprocation being in the same direction as the line of travel of material along screens 19, which will be described in greater detail hereinbelow. The frequency of motor 18 is about 600 revolutions per minute, and during operation, frame 16, screen box 33 and screens 19 are displaced about one inch in each direction.

An elongated generally rectangular-shaped screen box or enclosure 33 is removably mounted on frame 16 (FIGS. 1, and 3–5). Specifically, screen box 33 rests on top of and is suitably removably attached to vertical side plates 29. Screen box 33 includes a pair of spaced, parallel, elongated sidewalls 34, and a front end wall 35 which extends between and is connected to the front ends of sidewalls 34. A rear end of screen box 33 is formed with an inlet opening 36. Screen box 33 further includes a catch tray 37 which extends between and is connected to the lower ends of sidewalls 34 and front end wall 35. The front end of catch tray 37 is formed with three discrete openings, and specifically, first, second, and third outlet openings or chutes 39*a*, 39*b* and 39*c*, respectively. A pair of generally diagonally disposed support members 61 are attached by any suitable means to the interior surfaces of the walls of screen box 33, at each of the front and rear ends of the box (FIG. 2), to provide additional structural support to the box.

A first top bracket 40*t* extends between and is attached by any suitable means to the interior surface of the output end of sidewalls 34 of screen box 33, and a second top bracket 45*t* extends between and is attached to the interior surface of the input end of sidewalls 34, for removably mounting top screen 19*t* in screen box 33. Similarly, a first bottom bracket 40*b* extends between and is attached by any suitable means to the interior surface of the output end of sidewalls 34 of screen box 33, and a second bottom bracket 45*b* extends between and is attached to the interior surface of the input end of sidewalls 34, for removably mounting a bottom screen 19*b* in screen box 33. Each screen 19 preferably can range in size from about two to about five feet wide and from about eight to about twenty feet long, and generally is within a mesh range of from about 2 to about 325 mesh (12 millimeters to 45 microns), and preferably from about 4 to about 100 mesh (5 millimeters to 150 microns), and is most suitable for low-density material dry sizing operations. Screens 19*t, b*, preferably each are a pretensioned frame screen, although adjustable tension hook strip screens can be used if desired without affecting the performance of sizing apparatus 10. It is understood that, if desired, sizing apparatus 10 can be easily converted for use with a single screen 19. Also, the angle of screens 19 is adjustable, and if desired, screen box 33 can be enclosed With a dust cover (not shown).

A material feed box 41 formed with an upper inlet opening 42 is mounted by any suitable means on the rear end of screen box 33 adjacent to and in communication with opening 36.

In accordance with another important feature of the present invention, a material shaking apparatus 50 (FIGS. 2 and 3) is disposed between frame side members 23 directly below the central portion of screen box 33. More particularly, a bracket 51 extends between and is attached by any suitable means to the interior surface of screen box sidewalls 34. A thick, generally triangular-shaped impact transmission steel plate 52 is mounted on bracket 51 by any suitable means such as welding, and depends from the bracket and extends in the longitudinal or fore-aft direction relative to sizing apparatus 10. A pair of spaced-apart angle irons 53 extend transversely between frame side members 23 generally below and adjacent to triangular plate 52, and are attached to the bottom surface of screen box 33. A channel member 54 is mounted on and between angle irons 53, adjacent to triangular plate 52 and generally centered between frame side members 23. An impactor 55, of the type available from the Cleveland Vibrator Company of Cleveland, Ohio, is mounted on channel member 54 by bolts 56. A preferred impactor is Model 1300. Such impactors deliver one impact at a maximum frequency of once every three seconds through a five-port spool valve. A timer is used to vary the cycle required. However, if desired, a ball tray or other devices which could exert a similar force could be alternatively utilized without affecting the overall concept of the present invention.

The operation of particle sizing apparatus 10 of the present invention will now be described. Vibrator motor 18 is actuated and its efficient circular motion about the generally vertically disposed axis of the motor creates the combination of a generally circular planar motion of frame 16 and attached screen box 33 at the motor end of the apparatus, and a generally oblong linear reciprocating motion at the central and leaf spring end of the apparatus with the reciprocation being in the same direction as the line of travel of material along screens 19*t* and 19*b*. A low-density material to be processed, such as fertilizer or plastic pellets (not shown), is supplied to inlet opening 42 of feed box 41. The material travels through feed box 41 and passes through opening 36 (FIGS. 1 and 3) formed in the rear end of screen box 33, and onto the input end of vibrating screen 19*t*. The material then travels downwardly-frontwardly on screen 19*t*, with undesirable larger-sized particles remaining on the screen and dropping off the front end of the screen and passing through first chute 39*a* for removal. Desirable smaller-sized particles pass downwardly through screen 19*t* and onto screen 19*b*, and such particles similarly simultaneously travel downwardly-frontwardly on screen 19*b* and drop through second chute 39*b* for further use. Still other desirable even smaller-sized particles pass downwardly through screen 19*b* and onto catch tray 37 of screen box 33, and pass through third chute 39*c* for further processing.

Figure 2B:
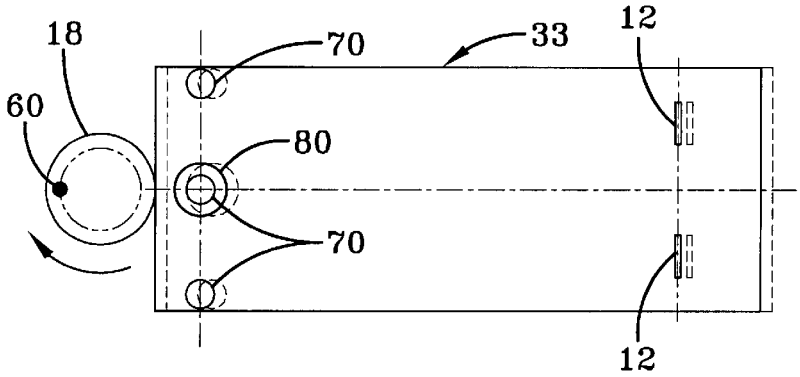
Figure 2C:
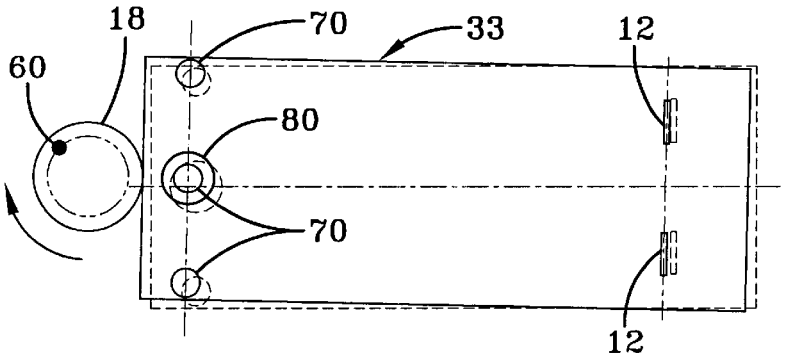
Figure 2D:
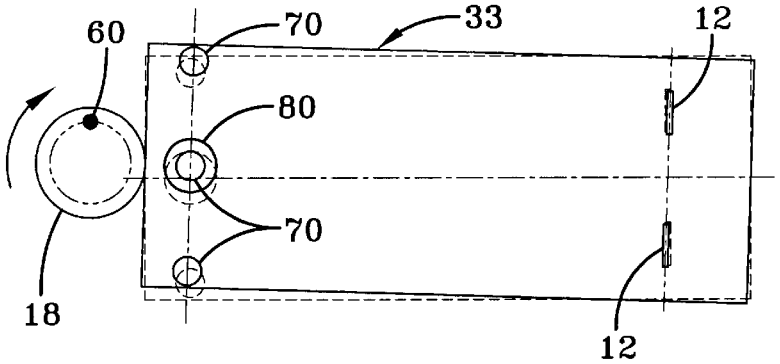

In accordance with one of the main features of the present invention, the combination of a generally circular planar motion of screen box 33 at the input or left-hand end of apparatus 10 and a generally oblong linear reciprocating motion at the output or right-hand end of the apparatus, with the reciprocation being in the same direction as the line of travel of material along screens 19, as best illustrated in the elapsed time series of drawings FIGS. 2A, 2B, 2C and 2D, aids in the efficient dry sizing and separation of low-density materials. The orientation and location of motor 18, and the circular motion of motor counterweight 60, results in such a combination motion. Specifically, motor counterweight 60 moves in the clockwise direction as best illustrated in FIGS. 2A, 2B, 2C and 2D. In FIG, 2A, motor counterweight 60 and screen box 33 are stationary. As motor counterweight 60 begins to rotate in a clockwise circular motion within motor 18, the resulting force causes the portions of frame 16, screen box 33 and screens 19 nearest motor 18, to move in a generally circular planar motion, and causes the central portion and right-hand end of frame 16, screen box 33 and screens 19 to move in a generally oblong linear reciprocating motion, as best illustrated in FIGS. 2B, 2C and 2D.

The described combination of a generally circular planar motion of sizing apparatus 10 at the left-hand or input end and a generally oblong linear reciprocating motion at the right-hand or output end is superior to prior art low-density particle sizing apparatus which utilize other types of motions to move material along the apparatus, such as non-planar gyratory and vertical motions. Sizing apparatus 10 is also superior to prior art low-density particle sizing apparatus which achieve a motion similar to that of the present invention, but which utilize more complicated, expensive apparatus to achieve such motion, such as gears. The present invention achieves the desired motion, and resulting low-density particle sizing, by utilizing a traditional vibratory motor 18 in a certain orientation, in combination with suspension components which include elastomeric springs 70 and leaf springs 12. Vibratory motor 18 is less costly, more durable and more efficient than other alternatives, such as gear-driven apparatus. The elongated screen box 33 also aids in strengthening the overall structure of the box and minimizes potential damage to the box due to the high-torque combination motion. The aforementioned support members 61 also contribute to the stability of screen box 33, and cross-shaped frame strengthening assemblies 62 enable frame 16 to withstand such forces. Nonetheless, in the event that leaf springs 12 fail, safety member 24 serves as a safety device and will catch the right-hand or output end of frame 16 and prevent it from further falling. Similarly, on the left-hand or input end of frame 16, safety cylinder 80 will prevent frame 16 from falling further in the event that elastomeric springs 70 fail.

While the combination of a generally circular planar motion at the left-hand or input end of screens 19 and a generally oblong linear reciprocating motion at the right hand or output end of screens 19 does promote the preferred linear movement of material on screens 19, the linear movement of said material is enhanced by the downward-frontward slope of the screens. Nonetheless, material moving down screens 19 can stick to or coat the mesh of the screens due to the fine particles of low-density materials being processed by sizing apparatus 10. Impactor 55 of material shaking apparatus 50 transmits a force to screens 19 to shake the sticking or coating low-density material fine particles from the mesh of the screens. More particularly, impactor 55 transmits an upward force in a direction perpendicular to the plane of screens 19 via channel member 54 and angle irons 53, which in turn transfer the impact into triangular plate 52 and bracket 51, which imparts the force into screen 19*b*. The force also transmits upward through screen box sidewalls 34 and into screen 19*t*. Such impact shakes any fine particles of the material which is sticking to or coating the mesh of screens 19.

The improved sizing apparatus 10 of the present invention can also be used for scalping, dedusting, polishing and removal of trash and foreign materials. Sizing apparatus 10 also is relatively economical to manufacture, use and maintain.

Accordingly, the particle sizing apparatus for low-density materials of the present invention is simplified, provides an effective, safe, inexpensive and reliable sizing apparatus and method which achieves all of the enumerated objectives, provides for eliminating difficulties encountered with prior low-density material sizing apparatus and methods, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved sizing apparatus and method is constructed, arranged and used, the characteristics of the construction, arrangement and method steps, and the advantageous, new and useful results obtained; the new and useful structures, devices, elements, arrangements, parts and combinations are set forth in the appended claims.

What is claimed is:

1. An apparatus for sizing and separating particles of a material, said apparatus including:

a) a stand;

b) a frame;

c) means attached to said stand and said frame for movably suspending the frame on the stand;

d) an enclosure mounted on the frame, said enclosure having a material input end, a central portion and a material output end;

e) at least one screen mounted in the enclosure, said screen being inclined downwardly in a direction from said enclosure input end to said enclosure output end; and f) a vibratory motor mounted on the frame, so that a generally circular planar motion is imparted to said frame, said enclosure and said screen at said enclosure input end, and a generally oblong linear reciprocating motion is imparted at said enclosure central portion and said output end.

2. The apparatus of claim 1, in which said frame is generally rectangular-shaped and includes a pair of spaced-apart elongated sides; in which said enclosure and said screen each is elongated; in which said vibratory motor is mounted on an end of said frame adjacent to said enclosure input end and; in which a shaft of said motor is disposed generally perpendicular to a horizontal surface upon which said stand is disposed; and in which a counterweight is contained in the motor.

3. The apparatus of claim 2, in which said screen has a mesh of from out 4 to about 100; in which the screen has a width of from about two feet to about five feet a length of from about eight feet to about twenty feet; in which each of said frame, said enclosure and said screen is displaced during operation of said apparatus about one inch; in which said motor operates at a frequency of about 600 revolutions per minute; and in which said material is a generally low-density material.

4. The apparatus of claim 4, in which top and bottom screens are removably mounted in said enclosure in a generally vertically spaced, parallel relationship.

5. The apparatus of claim 4, in which said enclosure has an inlet opening for receiving material at said input end; in which said enclosure output end is formed with first, second and third outlet openings; in which particles of said material failing to pass through said top screen pass through said first outlet opening; in which particles of the material which pass through said top screen and fail to pass through said bottom screen pass through said second outlet opening; and in which particles of said material which pass through said bottom screen pass through said third outlet opening.

6. The apparatus of claim 4, in which material shaking means is located adjacent to said screens for applying a force to the screens to aid in shaking loose particles of said material stuck to the screens.

7. The apparatus of claim 6, in which the material shaking means is an impactor device mounted on an exterior bottom surface of said enclosure generally adjacent to the central portion of said enclosure; and in which said impactor device transmits a force to the enclosure and to said screens at predetermined time intervals to aid in shaking loose particles of said material stuck to the screens.

8. The apparatus of claim 7, in which a generally triangular-shaped plate is mounted on an interior bottom surface of the enclosure generally adjacent to said impactor device; in which said plate extends upwardly between said enclosure interior bottom surface and contacts a member which extends transversely across generally the entire width of said bottom screen and generally abuts said screen; and in which an elongated periphery of said plate extends in the direction of travel of the material along the screens.

9. The apparatus of claim 2, in which a plurality of elastomeric shock absorbers are mounted on a bottom surface of said stand and extend between said stand and said horizontal surface upon which said stand is disposed.

10. The apparatus of claim 1, in which at least one cross-shaped frame-strengthening assembly is mounted on said frame; in which at least a pair of support members are mounted on said enclosure; and in which the enclosure is removably mounted on the frame.

11. A method of sizing and separating particles of a generally low-density material, using an apparatus comprising a stand, a frame, means attached to said stand and said frame for movably suspending the frame on the stand, an enclosure mounted on the frame, said enclosure having a material input end, a central portion and a material output end, at least one screen mounted in the enclosure, said screen being inclined downwardly in a direction from said enclosure input end to said enclosure output end, and a vibratory motor mounted on the frame for imparting a motion to said frame, said enclosure, and said screen, said method including the steps of:

a) actuating said vibratory motor for imparting a generally circular planar motion to said frame, said enclosure and said screen at said enclosure input end, and for imparting a generally oblong linear reciprocating motion at said enclosure central portion and said output end; and b) supplying said generally low-density material onto an upper end of said screen adjacent to said enclosure material input end, whereby said material advances downwardly on said screen from said enclosure input end to said enclosure output end.

12. The method of claim 11, in which said frame is generally rectangular-shaped and includes a pair of spaced-apart elongated sides; in which said enclosure and said screen each is elongated; in which said vibratory motor is mounted on an end of said frame adjacent to said enclosure input end; in which a shaft of said motor is disposed generally perpendicular to a horizontal surface upon which said stand is disposed; and in which a counterweight is contained in the motor.

13. The method of claim 12, in which said screen has a mesh of from about 4 to about 100; in which the screen has a width of from about two feet to about five feet and a length of from about eight feet to about twenty feet; in which each of said frame, said enclosure and said screen is displaced about one inch during operation of said apparatus; and in which said motor operates at a frequency of about 600 revolutions per minute.

14. The method of claim 13, in which top and bottom screens are removably mounted in said enclosure in a generally vertically spaced, parallel relationship.

15. The method of claim 14, in which said enclosure has an inlet opening for receiving material at said input end; in which said enclosure output end is formed with first, second and third outlet openings; in which particles of said material failing to pass through said top screen pass through said first outlet opening; in which particles of the material which pass through said top screen and fail to pass through said bottom screen pass through said second outlet opening; and in which particles of said material which pass through said bottom screen pass through said third outlet opening.

16. The method of claim 12, in which a plurality of elastomeric shock absorbers are mounted on a bottom surface of said stand and extend between said stand and said horizontal surface upon which said stand is disposed for absorbing dynamic loads during operation of the apparatus.

17. The method of claim 11, in which at least one cross-shaped frame-strengthening assembly is mounted on said frame; in which at least a pair of support members are mounted on said enclosure; and in which the enclosure is removably mounted on the frame.

18. The method of claim 11, in which material shaking means is located adjacent to said screen for applying a force to the screen to aid in shaking loose particles of said material coated on the screen.

19. An apparatus for sizing and separating particles of a material, said apparatus including:

a) a stand;

b) a frame that is generally rectangular-shaped and includes a pair of spaced-apart elongated sides;

c) an elongated enclosure mounted on the frame, said enclosure having a material input end, a central portion and a material output end;

d) a plurality of elastomeric springs mounted on and extending between said stand and said frame adjacent to said enclosure input end;

e) a pair of leaf springs mounted on and extending between said stand and said frame adjacent to said enclosure output end; thereby cooperating with said plurality of elastomeric springs for movably suspending said frame on said stand;

f) at least one elongated screen mounted in said enclosure, said screen being inclined downwardly in a direction from said enclosure input end to said enclosure output end;

g) a vibratory motor mounted on an end of said frame adjacent to said enclosure input end, so that a generally circular planar motion is imparted to said frame, said enclosure and said screen at said enclosure input end, and a generally oblong linear reciprocating motion is imparted at said enclosure central portion and said output end; and h) said motor including a counterweight and a shaft that is disposed generally perpendicular to a horizontal surface upon which said stand is disposed.

20. A method of sizing and separating particles of a generally low-density material, using an apparatus comprising a stand, a generally rectangular-shaped frame that includes a pair of spaced-apart elongated sides, an elongated enclosure mounted on the frame, said enclosure having a material input end, a central portion and a material output end, a plurality of elastomeric springs mounted on and extending between said stand and said frame adjacent to said enclosure input end, and a pair of leaf springs mounted on and extending between said stand and said frame adjacent to said enclosure output end, whereby said plurality of elastomeric springs and said pair of leaf springs cooperate to movably suspend the frame on the stand, at least one elongated screen mounted in the enclosure, said screen being inclined downwardly in a direction from said enclosure input end to said enclosure output end, and a vibratory motor mounted on an end of said frame adjacent to said enclosure input end for imparting a motion to said frame, said enclosure, and said screen, the motor including a counterweight and a shaft that is disposed generally perpendicular to a horizontal surface upon which said stand is disposed, said method including the steps of:

a) actuating said vibratory motor for imparting a generally circular planar motion to said frame, said enclosure and said screen at said enclosure input end, and for imparting a generally oblong linear reciprocating motion at said enclosure central portion and said output end; and b) supplying said generally low-density material onto an upper end of said screen adjacent to said enclosure material input end, whereby said material advances downwardly on said screen from said enclosure input end to said enclosure output end.

* * * * *